US006798637B1

(12) United States Patent
Graham

(10) Patent No.: US 6,798,637 B1
(45) Date of Patent: Sep. 28, 2004

(54) DYNAMIC AIR IONIZER AND METHOD

(75) Inventor: Martin Graham, Berkeley, CA (US)

(73) Assignee: Ion Systems, Berkeley, CA (US)

( * ) Notice: Subject to any disclaimer, the term of this patent is extended or adjusted under 35 U.S.C. 154(b) by 0 days.

(21) Appl. No.: 10/294,047

(22) Filed: Nov. 13, 2002

Related U.S. Application Data

(62) Division of application No. 09/698,707, filed on Oct. 27, 2000.

(51) Int. Cl.[7] ..... H01H 23/00
(52) U.S. Cl. ..... 361/230; 361/231
(58) Field of Search ..... 361/225, 226, 361/230, 231, 232, 233, 235, 229, 234

(56) References Cited

U.S. PATENT DOCUMENTS

| | | | | |
|---|---|---|---|---|
| 3,337,784 A | | 8/1967 | Lueder | |
| 3,417,302 A | | 12/1968 | Lueder | |
| 3,504,227 A | | 3/1970 | Wooton et al. | |
| 3,624,448 A | | 11/1971 | Saurenman et al. | |
| 3,711,743 A | | 1/1973 | Bolasny | |
| 3,873,835 A | | 3/1975 | Ignatjev | |
| 4,253,852 A | | 3/1981 | Adams | |
| 4,317,661 A | | 3/1982 | Sasaoka et al. | |
| 4,319,302 A | | 3/1982 | Moulden | |
| 4,333,123 A | | 6/1982 | Moulden | |
| 4,490,806 A | * | 12/1984 | Enke et al. | 708/445 |
| 4,517,143 A | | 5/1985 | Kisler | |
| 4,542,434 A | | 9/1985 | Gehlke et al. | |
| 4,633,083 A | * | 12/1986 | Knorr et al. | 250/282 |
| 4,729,057 A | | 3/1988 | Halleck | |
| 4,757,422 A | * | 7/1988 | Bossard et al. | 361/231 |
| 4,809,127 A | | 2/1989 | Steinman et al. | |
| 4,951,172 A | | 8/1990 | Steinman et al. | |
| 5,055,963 A | | 10/1991 | Partridge | |
| 5,057,966 A | | 10/1991 | Sakata et al. | |
| 5,153,811 A | | 10/1992 | Rodrigo et al. | |
| 5,710,427 A | * | 1/1998 | Schubert et al. | 250/282 |
| 5,930,105 A | | 7/1999 | Pitel et al. | |
| 6,002,573 A | | 12/1999 | Patridge | |
| 6,130,815 A | | 10/2000 | Pitel et al. | |
| 6,252,233 B1 | * | 6/2001 | Good | 250/423 R |
| 6,459,079 B1 | * | 10/2002 | Machlinski et al. | 250/286 |
| 6,467,426 B1 | * | 10/2002 | Takaoka et al. | 118/723 FI |
| 6,643,113 B2 | * | 11/2003 | Richie et al. | 361/213 |

FOREIGN PATENT DOCUMENTS

EP 0844 726 A2 9/1997

OTHER PUBLICATIONS

Baumann, John and Micki, "Metaphysical Home Page" [Online] [retrieved on Feb. 12, 2003]. Retrieved from the Internet <URL: http://www.lovesedona.com/01.htm, pp. 1–3, and 1–9.

3M 961 Ionized Art Blower instruction, 3M Corporation, ©1991 (A copy of this article was transmitted in an IDS filed on Feb. 22, 2001, with the parent case (Ser. No. 09/698,707).

Moeller, D.W., et al., "Laboratory and Field Tests of a Hassock Fan–Ion Generator Radon Decay Product Removal Unit," Oct. 7, 1987.

* cited by examiner

*Primary Examiner*—Brian Sircus
*Assistant Examiner*—Danny Nguyen
(74) *Attorney, Agent, or Firm*—Fenwick & West LLP

(57) ABSTRACT

Concentrations of positive and negative ions that are generated in the ambient air at a selected location are controlled in time-varying manner. Apparatus for generating air ions includes controllable high voltage sources and electrodes connected to the sources adapted to generate positive ions and negative ions in ambient air near the electrodes. Control circuitry is coupled to the high voltage sources to control the voltage levels at the electrodes for altering the quantities of positive ions and/or negative ions that are generated in time-varying manner within the ambient air about the electrodes. The control circuitry may control the voltage sources to generate a simulated ion signature of variations in ion concentrations as detected at a selected geographic location.

7 Claims, 1 Drawing Sheet

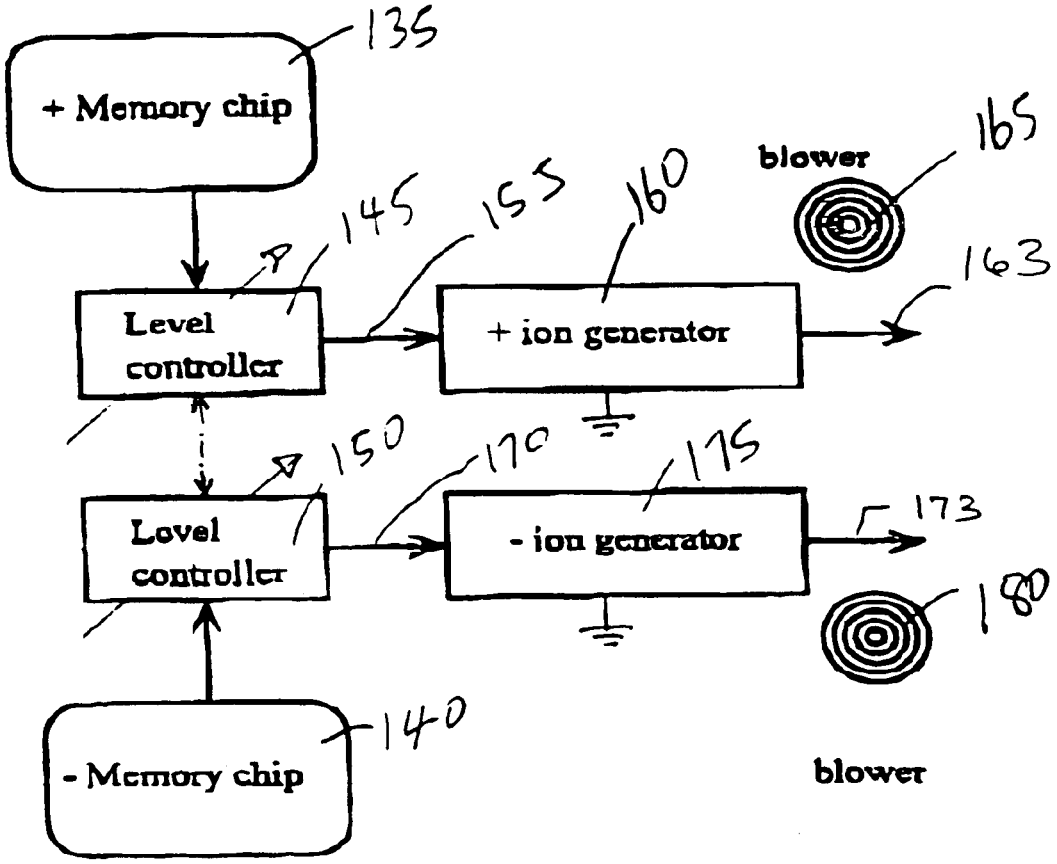
135
+ Memory chip
145
155
160
blower
165
163
Level controller
+ ion generator
150
170
175
Level controller
- ion generator
173
180
140
- Memory chip
blower

DYNAMIC AIR IONIZER AND METHOD

RELATED APPLICATIONS

This application is a divisional of U.S. application Ser. No. 09/698,707 entitled "Dynamic Air Ionizer and Method", filed on Oct. 27, 2000 by Martin Graham, which subject matter is incorporated herein by this reference to form a part hereof.

FIELD OF THE INVENTION

This invention relates to air ionizers and more particularly to an apparatus and method for producing time-varying quantities of positive and negative air ions.

BACKGROUND OF THE INVENTION

Individual molecules of the gases that constitute ambient air can acquire electrical charge and become positive or negative ions, depending upon whether a deficiency or an excess of electrons has been imparted to the molecule. Positive and negative ions are commonly present in the ambient air as a result of static electricity discharges and/or other natural causes.

High levels of air ionization can have the beneficial effects of removing particulate contaminants such as smoke particles or pollens from the air by transferring charge to such particles. The charged particles are electrostatically attracted to nearby surfaces that are electrically neutral or oppositely charged and are then deposited against such surfaces. Additionally, air with a high content of negative ions is believed to have beneficial physiological effects on persons who breathe the air.

Air inside buildings tends to become stale and unpleasant to breathe as a result of, in part, the depletion of the ion content in the air. Various conventional air ionizers have been developed to counteract the depletion of ions and also to purify air by causing the precipitation of particulate contaminants out of the air and onto nearby surfaces. Such conventional air ionizers typically include pointed electrodes that are connected to high voltage supplies to produce intense electrical fields adjacent the pointed electrodes. Neutral gas molecules in the vicinity of the intense electrical fields are transformed to positive or negative ions, depending upon the polarity of the high voltages on the electrodes. Electrostatic repulsion from the similarly charged electrodes and air blowers disperse the air ions throughout the room to cause precipitation of particulate contaminants from the air and to promote the beneficial physiological effects reported by some people who breathe the air. Such conventional air ionizers commonly produce predetermined ratios of positive to negative ions (for example, ratio in equal numbers), and such balancing can be maintained in a variety of ways that permit continued self-balancing of generated ions over a wide range of varying operating conditions. Air ionizers of this type are described in the literature. (See, for example, U.S. Pat. No. 5,055,963).

However, such conventional air ionizers typically do not have the capability of generating time-varying quantities of positive and/or negative ions. It is believed that rapid variations in the concentration and polarity of ions in the air over time promote physiologically desirable effects in people who are exposed to such air with modulated ion content.

SUMMARY OF THE INVENTION

The apparatus and method in accordance with the present invention produce ions of positive and negative polarity in time-varying manner to promote more physiologically desirable effects in people who are exposed to air with such modulated ion content. In one embodiment, the apparatus of the present invention is particularly suited for room installations and includes electrodes that are spaced apart and are energized to high voltage levels to form intense electrical fields adjacent each of the electrodes. The electrical field adjacent each electrode promotes the generation of positive or negative ions, and in one embodiment of the invention, level controllers are used to vary the concentration of ions of one or other polarity over time.

In one embodiment of the present invention, the level controller provides control signals that control the voltage level at the electrodes to permit positive and negative ions to be generated in quantities that vary aperiodically, randomly, or pseudo-randomly over time intervals (such as one to a few seconds). As a result, the ion concentration may vary rapidly or fluctuate within a range of minimum and maximum levels for one or other polarities.

In another embodiment of the invention, a controller controls generation of positive ions or negative ions in quantities that vary in a manner simulating the ion signature of a selected geographical location.

BRIEF DESCRIPTION OF THE DRAWINGS

The drawing is a block diagram of an air ionizer for producing positive and negative air ions in time-varying concentrations in accordance with an embodiment of the present invention.

DETAILED DESCRIPTION OF THE INVENTION

Referring now to FIG. 1, there is shown a block schematic diagram of one embodiment of an air ionizer (as an atmospheric conditioner) in accordance with the present invention. The level controller 145 supplies a control signal 155 to the positive ion generator 160 which responds by producing positive high voltage on electrode 163 at a potential or level that is representative of the applied control signal. The level controller 145 may be a conventional digital-to-analog converter that converts digital control information from memory chip digital circuitry 135 into analog control signals for driving the positive ion generator 160. Thus, variations in the control signal 155 from the level controller 145 varies the positive ions produced at the electrode 163 in similar varying manner.

Similarly, the level controller 150 supplies a control signal 170 to the negative ion generator 175 which responds by producing negative high voltage on electrode 173 at a potential or level that is representative of the applied control signal. The level controller 150 may be a conventional digital-to-analog converter that converts digital control information from memory chip digital circuitry 140 into control signals for driving the negative ion generator 175. Thus, variations in the control signal 170 from the level controller 150 varies the negative ions produced at the electrode 173 in similar manner. The positive ions and negative ions thus generated and dispersed result in a controlled atmosphere in the nearby region. The ion generators 160, 175 with their associated high voltage supplies may be controlled to generate ion densities near the electrodes 163, 173 ranging, for example, from about 500 ions/$cm^3$ to about 4,000 ions/$cm^3$.

A high voltage applied to an electrode 163, 173 produces an electrical field that is most intense in the region immediately adjacent a sharply pointed tip. The intense electrical field disrupts the normal charge state of molecules of air gases (e.g., nitrogen and oxygen) in the region adjacent to the sharply pointed tip. The molecules then become negative or positive ions, depending upon whether the molecule attains an excess or a deficiency of electrons. Ions of a polarity opposite from the polarity of a high voltage on an electrode 163, 173 are attracted to the electrode and are neutralized. Ions of the same polarity as the high voltage on an electrode 163, 173 are electrostatically repelled by the electrode and are dispersed outwardly. One or more blowers or fans 165, 180 may be disposed with respect to the electrodes 163, 173 to promote dispersal of the generated ions. The air ionizer in accordance with an embodiment of the present invention may be suitably attached in conventional manner to the ceiling of a room in which it is desirable to alter the ion content in the ambient air.

The level controllers 145, 150 may be operated in response to digital information from the associated memory chips digital circuitry 135, 140 to provide varying control signals 155, 170 that control the voltage levels on the electrodes 163, 173. In this manner, positive and negative ions are generated in quantities that may vary aperiodically, randomly, or pseudo-randomly over time intervals (such as one to a few seconds), as more specifically described below. Under such control, the ion generators 160, 175 may provide any or all of the following functions:

(1) generate positive ions in quantities that vary aperiodically, pseudo-randomly or randomly in time-varying manner; or (2) generate negative ions in quantities that vary aperiodically, pseudo-randomly or randomly in time-varying manner; or (3) generate positive and negative ions in quantities that separately vary, or that simultaneously both vary aperiodically, pseudo-randomly or randomly in time-varying manner.

In accordance with one embodiment of the present invention, specific patterns of time-varying ion generation may be achieved to simulate or resemble the ion density characteristics at so-called vortexes, for example, at such widely-publicized locations as Sedona, Ariz. Vortexes are believed to elevate or enhance the energy level in the human body and, as presently understood, are believed to be manifested by rapid variations and/or large fluctuations in ion concentrations which promote physiologically desirable effects in people who are exposed to air with such modulated ion content. Such patterns of ion concentrations are not deterministic in nature, but simulation of the naturally-occurring phenomena may be approximately achieved using conventional ion detectors deployed at target locations of natural vortexes to produce signals representative of ion concentrations and polarity variations with time. Such time-variable concentrations of air ions may be detected over a sampling interval of time for recordation and digital reproduction in conventional manner, for example, as data entries in a succession of addressable storage locations in memory chips 135, 140. The data entries in the memory chips 135, 140 may thus comprise digital representations of actual positive ion and negative ion concentrations at the selected geographical site over the test interval that are stored in conventional manner as digital values at successively-addressed locations in the memory chips 135, 140 for operation as read-only memories (ROMS). The memory chips 135, 140 thus store data entries that represent the "ion signature" of a given geographical area over a test interval. Thereafter, successive and cyclic addressing of the memory locations in the memory chips 130, 140 in conventional manner supplies the requisite control signals to the respective level controllers 145, 150 for operation thereof in the manner as previously described.

In operation, ion concentrations in air at a selected location may be controlled in accordance with a method of the present invention. The generated quantities of positive ions and/or negative ions are altered by the control signals 155, 170 that are supplied to the ion generators 160, 175. These control signals may be representative of the "ion signature" of a given geographical area, or may be random, or pseudo-random, or any suitable time-varying control signals for modulating the concentrations of positive ions and/or negative ions generated by the positive and negative ion generators 160, 175. Thus, the concentrations of ions produced at the electrodes 163, 173 may vary or fluctuate in time-varying manner over ranges of ion concentrations and polarities.

Therefore, ion generation in accordance with embodiments of the apparatus and method of the present invention establish time-varying concentrations of positive and/or negative ions within the ambient air of a controlled environment to promote beneficial physiological effects as perceived by some people in response to breathing such ambient air. One or more ion signatures of naturally-occurring variations in ion concentrations at selected geographic locations may be simulated by controlling positive and/or negative ion generation in response to time-varying control signals that are representative of stored versions of such ion signatures.

What is claimed is:

1. A method for controlling generation of air ions, comprising:

detecting levels of air ions naturally occurring in a selected geographic location over a sample time interval;

recording the levels of air ions detected in the selected geographic location over the sample time interval;

storing data representing the recorded levels of air ions over the sample time interval;

generating control signals representative of the stored data; and generating air ions in quantities indicative of the control signals to simulate the levels of air ions detected in the selected geographic location.

2. The method according to claim 1 in which the stored data represents substantial variations in recorded levels of air ions within an interval of the order of seconds.

3. A method for enhancing beneficial biological effects on a human by controlling air ions in ambient air about the human, the method comprising the steps for:

storing data representative of naturally-occurring varying levels of air ions detected in a selected geographic location over a sample time interval;

generating control signals representative of the stored data; and generating air ions in the ambient air in quantities indicative of the control signals to simulate the varying levels of air ions detected in the selected geographic location.

4. The method according to claim 3 in which substantial variations in the levels of air ions represented by the stored data occur within an interval of the order of seconds.

5. The method according to claim 3 in which air ions are generated in the ambient air in varying quantities substantially at levels of the natural environment over the sample time interval.

6. The method according to claim 5 in which the sample time interval is of the order of seconds.

7. The method according to claim 5 in which the air ions are generated in the varying quantities recurringly at a periodicity substantially equal to the sample time interval.

* * * * *